United States Patent [19]

Therrien

[11] Patent Number: 4,509,217

[45] Date of Patent: Apr. 9, 1985

[54] GUARDRAIL ASSEMBLY FOR HOSPITAL BED

[75] Inventor: Gaston Therrien, Montreal, Canada

[73] Assignee: Bertec Inc., Montreal, Canada

[21] Appl. No.: 481,943

[22] Filed: Apr. 4, 1983

[51] Int. Cl.[3] ..... A47C 21/08

[52] U.S. Cl. ..... 5/430; 5/428

[58] Field of Search ..... 5/430, 428, 429, 427, 5/425; 297/103, 101, 7

[56] References Cited

U.S. PATENT DOCUMENTS

| | | | |
|---|---|---|---|
| 2,625,694 | 1/1953 | Moss | 5/428 |
| 2,817,855 | 12/1957 | Pratt | 5/430 |
| 3,045,259 | 7/1962 | Mayer | 5/429 |
| 3,089,152 | 5/1963 | Murcott | 5/429 |
| 3,100,899 | 8/1963 | Wright | 5/430 |
| 3,220,023 | 11/1965 | Dewey | 5/428 |
| 3,336,609 | 8/1967 | Taylor | 5/430 |
| 3,506,989 | 4/1970 | Ross et al. | 5/430 |
| 3,604,024 | 9/1971 | Polanski | 5/430 |
| 3,851,345 | 12/1974 | Benoit et al. | 5/430 |
| 3,930,273 | 1/1976 | Stern | 5/430 |
| 4,103,376 | 8/1978 | Benoit et al. | 5/430 |

FOREIGN PATENT DOCUMENTS

| | | | |
|---|---|---|---|
| 792955 | 8/1968 | Canada | 5/430 |
| 1012307 | 6/1977 | Canada | 5/430 |

*Primary Examiner*—Alexander Grosz
*Assistant Examiner*—Vinh Luong
*Attorney, Agent, or Firm*—Robic, Robic & Associates

[57] ABSTRACT

Guardrail assembly for mounting on one side of a hospital bed having a horizontal bed frame. The assembly has a guardrail which is movable between a raised protection position and a lowered retracted position. It further has, at each end of the bed, an upward bracket; a link connected at one end to one end of the rail and pivoted adjacent the other end to the bracket so that it can move in a vertical plane, motion of both links thus causing movement of the rail between the aforesaid two positions. The assembly further provides for a pin locking mechanism on each bracket including a pin which is resiliently biassed toward the bracket and the locking end of the link for insertion in a hole of the bracket and a hole of the locking end when the guard is in the raised protection position and the holes register whereby to hold the guard in the raised position. Additionally, the pin of one of the locking mechanism has a knob at the end which is suitable to withdraw it from the hole of the link with which it cooperates. Finally, a linkage interconnects the pin locking mechanisms to cause simultaneous engagement and disengagement of the pins with the locking end holes by actuation of the manually operable knob.

8 Claims, 6 Drawing Figures

FIG. 1
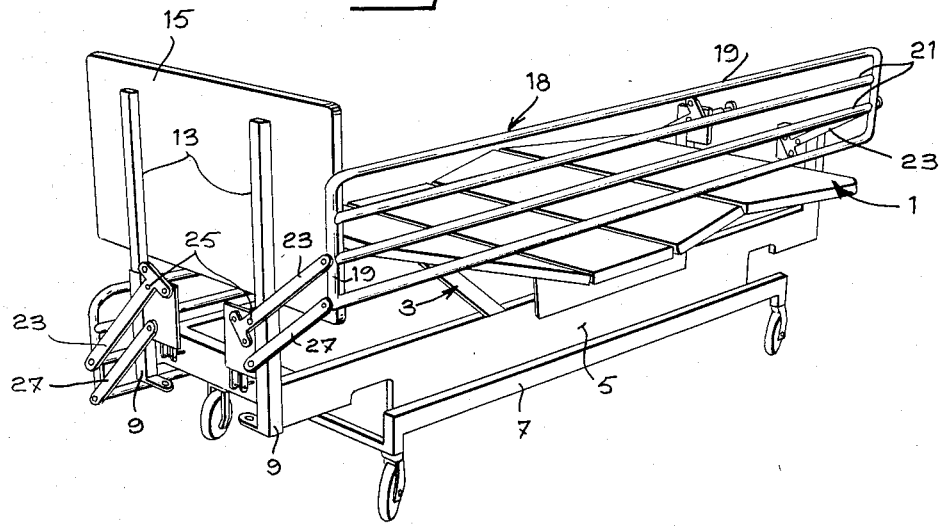
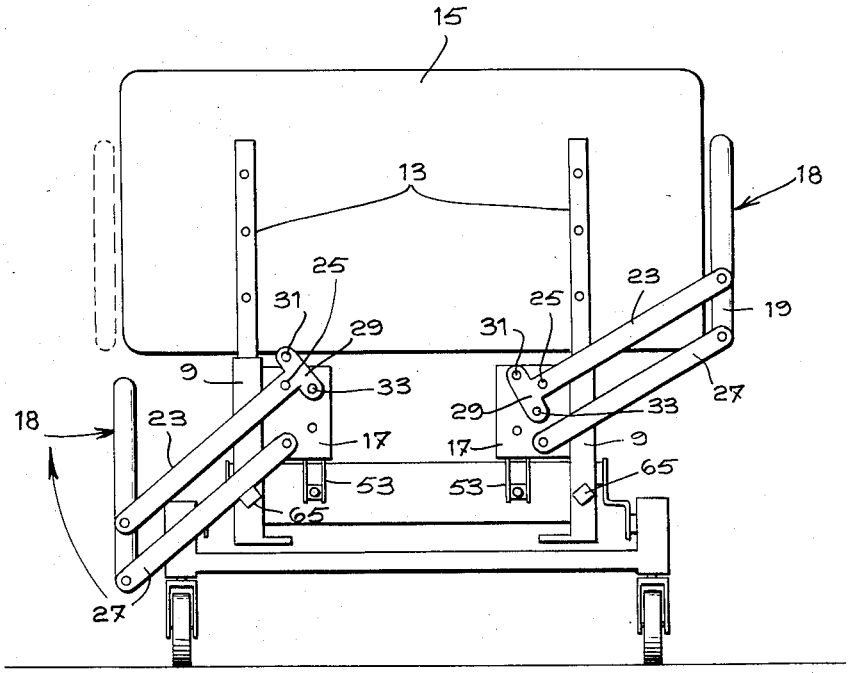
FIG. 2

FIG. 3
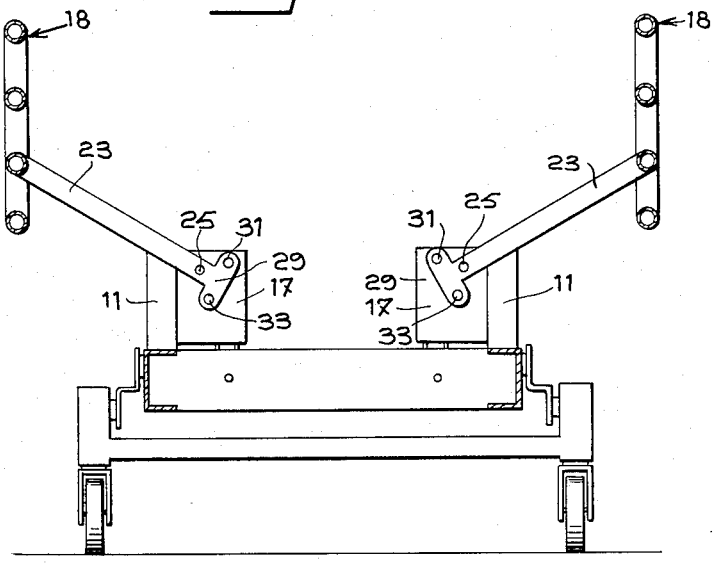
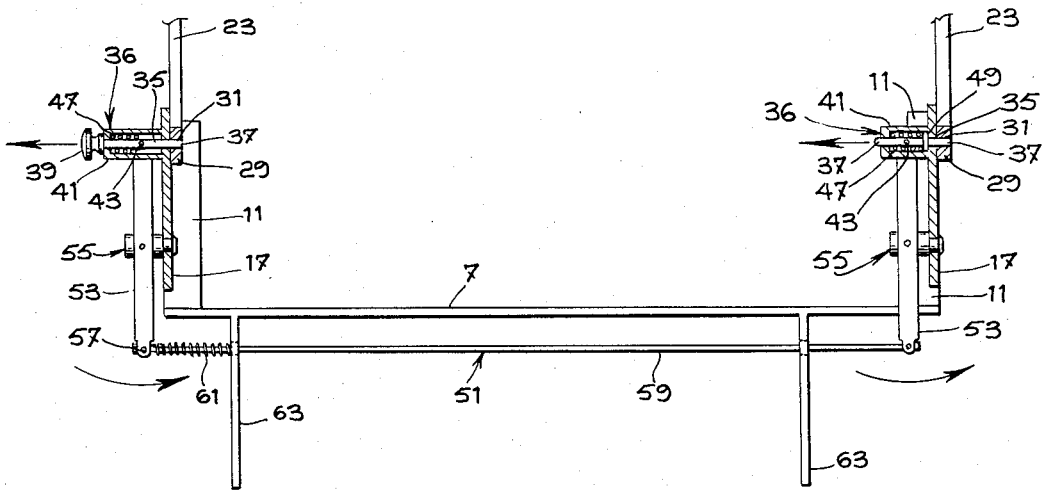
FIG. 4

GUARDRAIL ASSEMBLY FOR HOSPITAL BED

The present invention relates to the hospital bed art and more specifically to a guardrail assembly for a hospital bed.

As is of course known, the guardrails of such an assembly are each provided on one side of the bed and serve to prevent a patient from accidentally falling out of the bed. These guardrails are provided with a mechanical linkage making them movable, on either side individually, between a raised protection position, alongside and above the bed surface to a lower retracted position, alongside of the bed but below the bed surface.

Such hospital bed guardrail assemblies come of course in many different types. Possibly the simplest one of them is the assembly wherein the guardrail can be movably connected and disconnected from the bed. In another type, the assembly is integral with the bed and the guardrail is slid to either the lifted or lowered position. In one variation, it is possible to secure the rail at a plurality of vertical selected positions such as seen in beds for babies. There is another type of assembly wherein the guardrail can be swung underneath the bed for storage.

There are many disadvantages that are particular to each of the above-described types of guardrail assemblies. The present invention is more particularly concerned to improve another well known and more often met type of hospital guardrail assembly which is of the type wherein each guardrail is carried by arms, at their ends, that are pivotally mounted on brackets secured to the ends of the bed frame. There are, at least at one end of the bed, two arms defining essentially a pantograph so that as the rail is moved between the protection and retracted positions, through swinging action of the pivoting arms, it is kept generally vertical. When in raised protection position, the guardrail of this known type is secured in that position by a locking mechanism that acts on the pivoting arms at one end only of the bed. This locking mechanism is provided at the said one end so that the guardrail may be lifted and locked in raised protection position conveniently by only one person acting at that end. It will however be appreciated that the guardrail by thus being locked at one end only then hangs free at the other end in overhanging fashion so that the locking mechanism and the pivoting arms at the locking end become subjected to considerable stresses if a downward force is applied at the overhanging end, such as if someone leans on it. In fact, the overhanging rail may well sag under its own weight and to avoid this possibility, it has been proposed to apply a permanent twist to at least one of the bars of the guardrail to impart to it a slight lifting action on the overhanging end of the rail to counteract the tendency of the rail to droop under its own weight. As can easily be understood, this counteraction if of course far from being adequate to resist the more important force which is applied by a person who may inadvertently lean on the overhanging end.

It is consequently an object of the present invention to avoid the above drawback by providing a guardrail assembly having a lock mechanism capable of simultaneously locking both ends of the rail while being operable from a single end of the bed so that the locking operation may be carried out by one person only.

Accordingly, what is broadly claimed herein is essentially a guardrail assembly for mounting on one side of a hospital bed having a horizontal bed frame, the assembly comprising a guardrail movable between a raised protection position and a lowered rectracted position and, at each end of the bed: an upward bracket on the aforesaid one side of the bed; a link connected at one of its ends to one end of the rail; means connecting the link to the bracket for pivotal movement of the link in a vertical plane to thereby move the rail between the previously mentioned positions, it being provided that the link extends past the pivot means to define a locking end, and pin locking means on the bracket including a pin resiliently biassed toward the bracket and the locking end for insertion in a hole of the bracket and in a hole of the locking end when the guard is in the raised protection position and the holes register whereby to hold the guard in the raised position. In accordance with the invention, as herein broadly claimed, there is further provided that the pin of one of the pin locking means has manually operable means suitable to withdraw the pin from the hole of the link cooperating with the pin locking means having the manually operable means, and additional means interconnecting the pin locking means of the brackets to cause simultaneous engagement and disengagement of the pins with the link locking end holes by actuation of the manually operable means.

In accordance with a preferred embodiment of the invention, there is provided a guardrail assembly mounted on one side of a hospital bed of the type having a bed frame including a horizontal frame part and an upright bracket at either end and on one side of said horizontal part, said guardrail assembly including a guardrail extending along said side of said horizontal part and means connecting the ends of said rail to said upright brackets allowing movement of said rail between a raised position, suitable to protect a bed patient from accidentally falling out of the bed, and a retracted lowered position suitable to allow the patient to move in and out of the bed, the improvement wherein said rail connection means comprises:

a linkage means at either end of said bed frame, between said brackets and the ends of said rails, allowing movement of said rail between said positions; each linkage means comprising at least one link connected at one end to one end of said rails;

means pivotally connecting said links to said upright brackets, intermediate the ends of said links to define link locking ends projecting from said pivot means in a direction away from said one end of said links; said pivot means allowing swinging of said links in parallel vertical planes during movement of said rail between said position;

wherein each bracket has a pin locking hole and each link locking end has a pin locking hole; the pin locking holes of said locking ends being located thereon so as to register with the pin locking holes of the brackets cooperating therewith when said guardrail is in said raised position;

pin locking means, on said brackets, including locking pins extending through said bracket locking holes and resilient means biassing said pins toward said locking end holes of said links so as to move thereinto when said rail is in said raised position and said locking holes are in registry whereby to hold said rail in said raised position;

manual means on one of said pins operable to withdraw said one of said pins from the corresponding end hole against the resilient bias acting on said one of said pins, and means interconnecting said pin locking means to cause simultaneous engagement and disengagement of said pins with said link locking end holes whereby locking of said guardrail in raised position and at both ends of said bed may be achieved at the end only of said bed that has said manual means.

Preferably, the link locking ends have an additional locking hole located so as to register with the bracket locking holes when the rail reaches retracted position so that it can be locked in retracted position by movement of the locking pins in these additional locking holes.

The aforesaid pin locking means may comprise: hollow cylinders having one open end and secured by this open end to the brackets coaxially with the pin locking holes of the brackets, the locking pin resilient means being housed within the cylinders; furthermore, the locking pins include a transverse trunnion extending through and out of elongated slots of the cylinders, the locking pins extending outwardly through the closed ends of the cylinders and the manual means is then a knob at the outwardly extending end of one of the pins. The means interconnecting the pin locking means may comprise: a pair of upward levers each mounted on one of the brackets, below the cylinders, for rocking motion about a horizontal axis transverse to the bed; a horizontal elongated movement transmitting rod beneath the bed and pivotally connected at the ends thereof respectively to the lower ends of the aforesaid upward levers; and means pivotally mounting the upper ends of the levers respectively to the ends of the trunnions that extend outwardly of the cylinders, the construction being so that pulling on the knob against the bias of the locking pin resilient means rocks the levers through the movement transmitting rod and pulls the pins out of the link locking end holes to release the links and guardrail for free movement between their upper and lower positions.

Other features and advantages of the invention will become apparent from the description that follows of a preferred embodiment having reference to the appended drawings wherein:

FIG. 1 is a schematic perspective view showing a hospital bed provided with a guardrail assembly incorporating the features of the present invention;

FIG. 2 is a side elevation view of the bed of FIG. 1 from the head end thereof;

FIG. 3 is a side elevation view of the bed of FIG. 1 from the foot end thereof;

FIG. 4 is a schematic side elevation view, partly in cross section, more particularly illustrating the guardrail locking mechanism;

Figure 5:
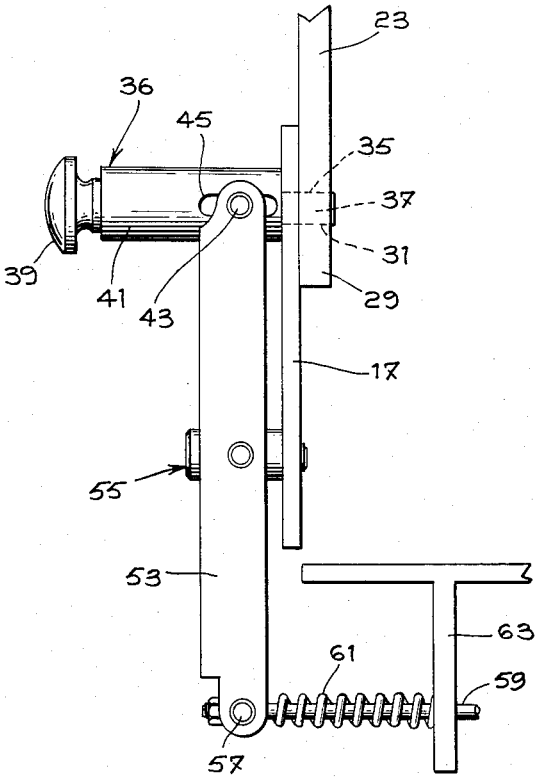
FIG. 5 is a side elevation view, on an enlarged scale, of part of the guardrail locking mechanism.

As a point of general interest, it may be pointed out at this time that each bed has two identical guardrail assemblies, as is usually the case, one on either side thereof and operable independently of one another. Therefore, the following description will be limited to one such assembly only.

Referring now to the embodiment as illustrated in the appended drawing, the guardrail assembly can be adapted to any type of hospital bed having conventional frame elements to which the assembly may be attached. This is particularly shown in FIGS. 1 and 2 where the assembly made according to the invention is mounted on a bed having a sectional resting structure 1 of which the sections are adjustably mounted, through a lever mechanism generally denoted by numeral 3, on a horizontal bed frame part 5 connected to a floor engaging frame 7, all in known manner. Upright posts 9 rise from the head end of the horizontal frame part 5 while similar upright posts 11 (FIG. 3) rise from the foot end of the bed frame part 5. The upright posts 9 are square in cross-section and hollow to slidably receive upright standards 13 to which a head board is secured. Thus, the head board 15 and standards 13 may bodily be removed, if need be. It will be understood that a similar board construction is provided at the foot end of the board but is not shown in the drawing for the sake of greater clarity. For this purpose, the upright posts 11 (FIG. 3) are likewise square in cross-section and hollow.

Secured to the upright posts 9, 11 are mounting brackets 17, each extending upwardly and inwardly with respect to the bed surface. The guardrail 18 proper may be of various forms and in the illustrated embodiment, it is comprised of a circumscribing bar 19 having two inner bars 21 parallel to the top and bottom bars of the circumscribing bar 19. As mentioned previously, the invention is more particularly concerned with means connecting the ends of the rail 18 to the upright brackets 17 which allows movement of the rail 18 between a raised position (at the right in FIG. 2), suitable to protect a bed patient from accidentally falling out of the bed, and a retracted lowered position (left of FIG. 2) suitable to allow the patient to move in and out of the bed. The embodiment of this rail connecting means, shown in the appended drawings, is as follows.

A linkage means is provided at either end of the bed frame and extends between the brackets 17 and the ends of the rail 18, more specifically the downward portions of the circumscribing bar 19, this linking means precisely allowing the aforesaid movement of the rail 18 between the upper and lower positions aforesaid. Involved in this linkage means is at least one link 23, at either end of the horizontal bed frame part 5, pivotally connected at one end to one end of the rail 18, such as close to the third lower horizontal bar of the guardrail 18. The other ends of these links 23 are pivotally connected, as at 25, to the mounting brackets 17. In order to obtain proper guiding of the movements of the rail 18, at least one additional link 27 is necessary which has the ends thereof respectively pivoted at the lower end of the rail 18 and on the bracket 17, beneath the pivot 25. As clearly shown in FIGS. 1 and 2, the links 23 and 27 along with the part of the bracket 17 and the part of the bar 19 inbetween their respective pivot are equal so as to form a pantograph suitable to allow displacement of the rail 18 between the lower and upper positions while keeping the rail 18 generally in a vertical plane. As will be understood, there is truly no need to provide a pantograph at both ends of the bed frame, the pantograph being needed at one end only.

Figure 6:
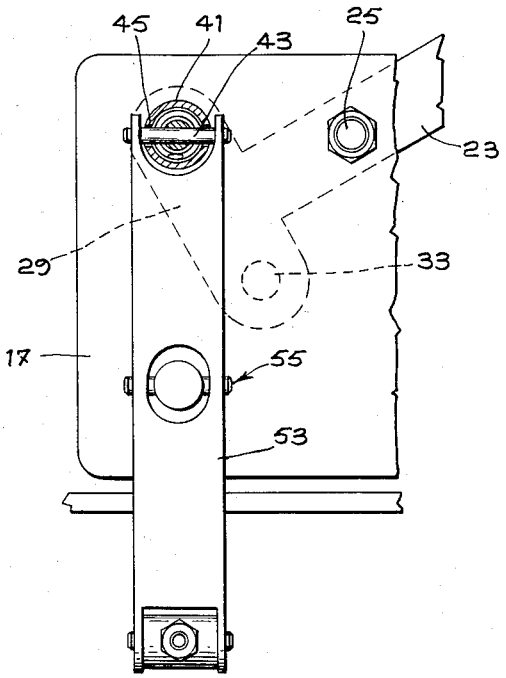
FIG. 6 is an end view of the mechanism of FIG. 5.

As best shown in FIGS. 1, 2 and 6, the pivots 25 are provided intermediate the ends of the links 23 thereby defining link locking ends 29 projecting from the pivots 25 in a direction away from the ends of the links 23 that are pivotally connected to the rail 18. As will be gathered from the illustration in FIG. 1, the pivots 25 allow swinging of the links 23 in parallel vertical planes during movement of the rail 18.

Each such link locking end 29 has a pair of link locking end holes 31, 33 while each bracket 17 has a single locking hole 35 best illustrated in FIGS. 4 and 5. It should be understood here that the holes 31 are located on the link locking ends 29 so as to register with the locking hole 35 of the brackets 17 when the rail 18 is in its raised protection position whereas the locking holes 33 register with the bracket hole 35 when the rail 18 is in its lower retracted position.

The rail 18 is held in either one of the two positions by means of two pin locking means 36 each secured to one of the upright brackets 17 and each including a locking pin 37 extending through the corresponding bracket locking hole 35 and resiliently biassed toward the locking end hole 31 of the corresponding link 23 so as to move into it when the rail 18 is in raised position and the locking holes 35, 31 are in registry so that the rail 18 can be held in raised position. Similarly, the rail 18 may be held in its lowered retracted position when the holes 33 of the link locking ends 29 are made to register with the holes 35 of the mounting brackets 17 in which case the pins 37 immediately enter into the locking holes 33. Manual means, such as a knob 39 (FIGS. 4 and 5) is provided on one of the locking pins 37 so that the latter may be withdrawn from its locking hole 31, 33 when the knob 39 is pulled against its resilient bias. In order that release of both locking pins 37 simultaneously release the links 23 and, hence, the rail 18 that they support, there is provided means interconnecting the pin locking means 36 suitable to cause simultaneous engagement and disengagement of the locking pins 37 with the link locking end holes 31, 33 whereby locking of the guard rail 18 in raised position or lowered position may be achieved by a person acting at only one end of the bed.

One form of pin locking means 36 may comprise, as shown particularly in FIGS. 4 and 5, a hollow cylinder 41 having an open end and secured by this open end to the upright brackets 17, as by welding, coaxially with the pin locking hole 35 of the brackets 17. The locking pin 37 includes a transverse trunnion 43 extending through and out of elongated slots 45 (FIG. 5) of the cylinder 41. Finally, the pin locking means includes the aforesaid resilient means in the form of a coil spring 47. In the pin locking means at the left of FIG. 4, the spring 47 bears against the knob end of the cylinder 41 while the other end abuts the transverse trunnion 43 so as constantly to bias the pin 37 rightward toward the link locking end 29.

The pin locking means 36 shown on the right of FIG. 4 is exactly the same as that on the left side with the following minor variations. As in the former pin locking means, the pin 37 extends out through the closed end of the hollow cylinder 41 but is devoid of any knob since none is necessary. Pin 37 simply slides through an appropriate opening through the closed wall of the cylinder 41. The coil spring 47, as in the previous case, bears against the closed end of the cylinder 41 and against the trunnion 43. A flange 49, at the end of the pin 37 close to the mounting bracket 17 serves the same abutting purpose as a similar flange of the knob 39 in the pin locking means located on the left of FIG. 4.

In order that both pins 37 simultaneously serve to engage and disengage the links 23 and, hence, allow shifting of the rail 18, there is provided a means 51 interconnecting the pin locking means 36, such interconnecting means 51 being constructed as follows.

Two rocking levers 53 are mounted on the brackets 17 by means of rocking assemblies suitable to allow the levers 53 to rock in a common vertical plane and about parallel axes transverse to the bed horizontal frame part. The ends of these levers 53 are shaped as forks of which the branches, at one end, receive the ends of the trunnions 43 for pivotal mounting thereof. The branches of the other forked end of the levers 53 likewise serve as pivotal support for trunnions 57 extending transversely of and solid with the ends of an elongated horizontal movement transmitting rod 59 located beneath the bed.

As will be gathered from the above description, and with particular reference to FIG. 4, whenever the knob 39 is pulled leftward sufficiently to disengage the pin 37 from the hole 31 of the link 23 against the bias of its spring 47, the lever 53 will rock counterclockwise through its connection with the trunnion 43 of the pin 37. Counterclockwise rocking of the lever 53 then shifts the elongated interconnecting rod 59 rightward to cause a like counterclockwise rotation of the rightward lever 53 again causing disengagement of the pin 37 from the corresponding hole 31 of the parent link 23 against the bias of the spring 47. It will thus be appreciated that simultaneous unlocking of the links 23 (and of course of the guardrail 18) may be obtained by acting solely with the one pin locking means 36 that has the manually operable means or knob 39.

Once the rail 18 is unlocked from one position, it may be moved to the other position and locked into position by allowing the pins 37 to move into the corresponding link locking holes 31 under the bias of the coil springs 47.

As shown in FIG. 4, additional bias may be given to the pins 37 and rocking levers 53 by providing a coil spring 61 disposed around the elongated rod 59 and having one end abut the lower end of one lever 53 while the other end abuts against a flange 63 extending downwardly from the floor engaging frame 7. In fact, two such flanges 63 may be mounted beneath the frame 7 to serve as bearings for the horizontally displaceable interconnecting rod 59.

If the spring 61 is strong enough, then use of the coil springs 47 within the cylinders 41 may be entirely avoided.

While additional holes 33 have been provided through the link locking ends 29 (FIG. 3) these holes 33 may also be dispensed with by providing limit blocks 65 (FIG. 2) suitable to stop the lower links 27 and thus the rail 18 in its lowered retracted position. For greater safety, these blocks 65 may even be provided along with the additional locking holes 33.

I claim:

1. A guardrail assembly mounted on one side of a hospital bed of the type having a bed frame including a horizontal frame part (5) and an upright bracket (17) at either end and on one side of said horizontal part, said guardrail assembly including a guardrail (18) extending along said side of sid horizontal part and means connecting the ends of said guardrail to said upright brackets (17) for allowing movement of said guardrail between a raised position, suitable to protect a bed patient from accidentally falling out of the bed, and a retracted lowered position suitable to allow the patient to move in and out of the bed, the improvement wherein said rail connection means comprises:

linkage means at both ends of said bed frame between said brackets and the ends of said guardrail for allowing movement of said guardrail between said raised and lowered positions; each linkage means comprising at least one link (23) having one end connected to one end of said guardrail and another end provided with a pin locking hole (31);

means (25) pivotally connecting said at least one link (23) intermediate its end to the upright bracket (17); said pivot means allowing swinging of said links (23) in parallel vertical planes during movement of said guardrail between said raised and lowered positions;

pin locking holes (35) provided in the upright brackets (17), said holes (35) in the brackets (17) being located so as to register with the pin locking holes (31) of the links (23) when said guardrail is in its raised position;

pin locking means (36) on said brackets, including locking pins (37) extending through said bracket locking holes (31) and resilient means biasing said pins (37) toward said locking hles (31) of said links (23) so as to move thereinto when the guardrail is in its rised position and the locking holes (31) of said in said raised position;

manual means (39) on one of said pins (37) said manual means being operable to withdraw said one pin, and means (51) interconnecting said pin locking means (36) to cause simultaneous engagement and disengagement of the pins (37) with the locking holes of the links (23) at both ends of the bed, whereby locking of said guardrail in raised position and at both ends of said bed may be achieved at the end only of said bed that has said manual means, wherein each of said pin locking means (36) comprises a hollow cylindr (41) having one open end secured to the corresponding bracket (17) coaxially with the pin locking hole (35) of said bracket, said locking pin resilient means (47) being housed within said cylinder; the locking pin in said cylinder including a transverse trunnion (43) extending through and out of elongated slots (45) of said cylinder;

wherein one of said locking pins extends outwardly through the closed end of its cylinder;

wherein said manual means is a knob (39) mounted at the outwardly extending pin; and wherein said means interconnecting said pin locking means (36) comprise: a pair of upward levers (53) each mounted on one of said brackets (17 below said cylinders, for rocking motion about a horizontal axis transverse to said bed; a horizontal elongated movement transmitting rod (59) beneath said bed and pivotally connected at the ends thereof respectively to the lower ends of said upward levers; and means pivotally mounting the upper ends of said levers (53) respectively to the ends of said trunnions (43) extending outwardly of said cylinders (41), constructed so that pulling on said knob (39) against the bias of said locking pin resilient means (47) rocks said levers (53) through said movement transmitting rod (59) and pulls said pins (37) out of said locking holes (31) of the links (23) to release said links and guardrail for free movement between said raised and lowered positions.

2. A guardrail assembly as claimed in claim 1, wherein the end of each link (23) opposite to the one connected to the guardrail (18) has an additional locking hole (33); the said additional locking holes (33) being located so as to register with said bracket locking holes (35) when said guardrail reaches its retracted position whereby to be locked in said retracted position by movement of said locking pins in said additional locking holes.

3. A guardrail assembly as claimed in claim 2, wherein said pin locking holes (31) and additional pin locking holes (33) are provided at the ends of a cross bar defining a T shape at the other end of each link (23) opposite to the end connected to the guardrail.

4. A guardrail assembly as claimed in claim 1, wherein said movement transmission rod (59) extends slidably through a flange (63) of said bed frame and said pin biassing means further includes a coil spring (61) around said rod (59) between said flange (63) and an adjacent lower end of one of said levers (53).

5. A guardrail assembly as claimed in claim 1, wherein at least one of said linkage means comprises an additional link (27) havint its ends pivotably connected to the corresponding bracket (17) and the corresponding end of the guardrail (18) respectively, to form, along with the link (23) said corresponding bracket (17) and part of said corresponding end of the guardrail, a pantograph suitable to allow displacement of the guardrail between its raised and lowered positions while keeping it generally in a vertical position.

6. A guardrail assembly mounted on one side of a hospital bed of the type having a bed frame including a horizontal frame part (5) and an upright bracket (17) at either end and on one side of said horizontal part, said guardrail assembly including a guardrail (18) extending along said side of said horizontal part and means connecting the ends of said guardrail to said upright brackets (17) for allowing movement of said guardrail between a raised position, suitable to protect a bed patient from accidentally falling out of the bed, and a retracted lowered position suitable to allow the patient to move in and out of the bed, the improvement wherein said rail connection means comprises:

linkage means at both ends of said bed frame between said brackets and the ends of said guardrail for allowing movement of said guardrail between said raised and lowered positions; each linkage means comprising at least one link (23) having one end connected to one end of said guardrail and another end provided with a pin locking hole (31);

means (25) pivotally connecting said at least one link (23) intermediate its ends to the upright bracket (17); said pivot means allowing swinging of said links (23) in parallel vertical planes during movement of said guardrail between said raised and lowered positions;

pin locking holes (35) provided in the upright bracket (17), said holes (35) in the brackets (17) being located so as to register with the pin locking holes (31) of the links (23) when said guardrail is in its raised position;

pin locking means (36) on said brackets, including locking pins (37) extending through said bracket locking holes (31) and resilient means biassing said pins (37) toward said locking holes (31) of said links (23) so as to move thereinto when the guardrail is in its raised position and the locking holes (31) of said links (23) are in registry whereby to hold said guardrail in said raised position;

manual means (39) on one of said pins (37) said manual means being operable to withdraw said one pin, and means (51) interconnecting said pin locking means (36) to cause simultaneous engagement and disengagment of the pins (37) with the locking holes of the links (23) at both ends of the bed, whereby locking of said guardrail in raised position and at both ends of said bed may be achieved at the end only of said bed that has said manual means, wherein the end of each link (23) opposite to the one connected to the guardrail (18) has an additional locking hole (33); the said additional locking holes (33) being located so as to register with said bracket locking holes (35) when said guardrail reaches its retracted position whereby to be locked in said retracted position by movement of said locking pins in said additional locking holes;

wherein each of said pin locking means (36) comprises a hollow cylinder (41) having one open end secured to the corresponding bracket (17) coaxially with the pin locking hole (35) of said bracket, said locking pin resilient means (47) being housed within said cylinder; the locking pin in said cylinder including a transverse trunnion (43) extending through and out of elongated slots (45) of said cylinder;

wherein one of said locking pins extends outwardly through the closed end of its cylinder;

wherein said manual means is a knob (39) mounted at the outwardly extending pin; and wherein said means interconnecting said pin locking means (36) comprise: a pair of upward levers (53) each mounted on one of said brackets (17) below said cylinders, for rocking motion about a horizontal axis transverse to said bed; a horizontal elongated movement transmitting rod (59) beneath said bed and pivotally connected at the ends thereof respectively to the lower ends of said upward levers; and means pivotally mounted the upper ends of said levers (53) respectively to the ends of said trunnions (43) extending outwardly of said cylinders (41), constructed so that pulling one said knob (39) against the bias of said-locking pin resilient means (47) rocks said levers (53) through said movement transmitting rod (59) and pulls said pins (37) out of said locking holes (31) of the links (23) to release said links and guardrail for free movement between said raised and lowered positions.

7. A guardrail assembly as claimed in claim 6, wherein said pin locking holes (31) and additional pin locking holes (33) are provided at the ends of a cross bar defining a T shape at the other end of each link (23) opposite to the end connected to the guardrail.

8. A guardrail assembly as claimed in claim 6, wherein at least one of said linkage means comprises an additional link (27) having its ends pivotably connected to the corresponding bracker (17) and the corresponding end of the guardrail (18) respectively, to form, along with the link (23), said corresponding bracket (17) and part of said corresponding end of the guardrail, a pantograph suitable to allow displacement of the guardrail between its raised and lowered position while keeping it generally in a vertical position.

* * * * *